US009339102B2

(12) United States Patent
Iosilevich et al.

(10) Patent No.: US 9,339,102 B2
(45) Date of Patent: May 17, 2016

(54) TACTICAL DRESS BELT ASSEMBLY

(71) Applicants: David Iosilevich, Washington, DC (US); Jill H. Aaron, Washington, DC (US)

(72) Inventors: David Iosilevich, Washington, DC (US); Jill H. Aaron, Washington, DC (US)

(73) Assignee: 323, LLC, Washington, DC (US)

( * ) Notice: Subject to any disclaimer, the term of this patent is extended or adjusted under 35 U.S.C. 154(b) by 170 days.

(21) Appl. No.: 13/837,509

(22) Filed: Mar. 15, 2013

(65) Prior Publication Data

US 2014/0259300 A1 Sep. 18, 2014

(51) Int. Cl.

| | |
|---|---|
| ***A45F 3/14*** | (2006.01) |
| ***A45F 5/02*** | (2006.01) |
| ***A41F 9/00*** | (2006.01) |

(52) U.S. Cl.

CPC . *A45F 5/021* (2013.01); *A41F 9/00* (2013.01); *A45F 3/14* (2013.01); *A45F 2003/144* (2013.01); *A45F 2200/0591* (2013.01)

(58) Field of Classification Search

CPC ..... A41F 9/00; A41F 9/002; A41F 9/005; A41F 9/007

USPC ..... 2/308, 300, 311, 309

See application file for complete search history.

(56) References Cited

U.S. PATENT DOCUMENTS

| | | | | |
|---|---|---|---|---|
| 4,516,275 | A * | 5/1985 | Schroeder | 2/308 |
| 4,747,527 | A * | 5/1988 | Trumpower, II | 224/662 |
| 4,957,231 | A * | 9/1990 | Kalisher | 224/583 |
| 5,464,136 | A * | 11/1995 | Eddy | 224/666 |
| 5,819,320 | A * | 10/1998 | Jolla | 2/236 |
| 5,941,438 | A * | 8/1999 | Price | 224/662 |
| D424,294 | S * | 5/2000 | Lundyn | D3/226 |
| 6,264,081 | B1 * | 7/2001 | Wojciak et al. | 224/251 |
| 7,575,136 | B2 * | 8/2009 | Kernkamp | 224/159 |
| 7,596,816 | B1 * | 10/2009 | Henry et al. | 2/227 |
| 7,762,440 | B2 * | 7/2010 | Cook | 224/195 |
| 8,011,545 | B2 * | 9/2011 | Murdoch et al. | 224/672 |
| 8,474,673 | B2 * | 7/2013 | Murdoch et al. | 224/672 |
| 2006/0090710 | A1 * | 5/2006 | Zazzara et al. | 119/770 |
| 2007/0057003 | A1 * | 3/2007 | Keyes | 224/663 |
| 2009/0126083 | A1 * | 5/2009 | Holtzclaw, Jr. | 2/300 |
| 2009/0139014 | A1 * | 6/2009 | Trochlil-Crist | 2/338 |
| 2009/0235431 | A1 * | 9/2009 | Bevley | 2/227 |
| 2010/0107310 | A1 * | 5/2010 | Taylor | 2/301 |
| 2013/0025027 | A1 * | 1/2013 | Spence | 2/227 |

* cited by examiner

*Primary Examiner* — Shaun R Hurley
*Assistant Examiner* — Andrew W Sutton
(74) *Attorney, Agent, or Firm* — R. Tracy Crump

(57) ABSTRACT

The tactical dress belt assembly allows a wearer to readily and comfortably carry a variety of tactical items, while maintaining a conventional dress appearance. The tactical dress belt assembly is a two or three component system, including an inner belt, and either a combined outer utility belt with an integral front dress belt section or separate dress belt over an outer utility belt. The inner belt is worn to hold up the wearer's trouser and typically is run through the belt loops of the wearer's trousers. The outer belt fits over the inner belt and provides a comfortable load bearing platform for a variety of carried items. The integrated front dress belt section or separate dress belt covers the front of the inner belt so that only the outer dress belt is visible when a coat or jacket is worn.

9 Claims, 14 Drawing Sheets

TACTICAL DRESS BELT ASSEMBLY

This application claims the benefit of U.S. Provisional Patent Application Ser. No. 61/612,773 filed Mar. 19, 2012, the entirety of which is incorporated by reference herein.

This invention relates to belts worn by plain clothed law enforcement personnel and protective service personnel, and specifically relates to a belt assembly that combines the covert appearance of a conventional dress belt and the utility of a load bearing tactical belt.

BACKGROUND AND SUMMARY OF THE INVENTION

Uniformed police officers use thick heavy duty belts to carry and support a wide variety of items. Typically, these duty belts and the items they carry and support are purposely visible when worn by a uniformed officer. While suitable for uniformed police and security personnel, wearing a visible duty belt loaded with tactical items is not ideal for plain clothed law enforcement personnel and protective service personnel that need to maintain a low profile or covert appearance, but still need to have such items carried on their person.

The tactical dress belt assembly of this invention allows a wearer to readily and comfortably carry a variety of tactical items, while maintaining a conventional dress appearance. The tactical dress belt assembly is a two or three component system, consisting of an inner belt, and either a combined outer utility belt with an integral front dress belt section or separate dress belt over an outer utility belt. The inner belt is worn to hold up the wearer's trousers or pants (not shown) and typically is run through the belt loops of the wearer's trousers. The outer belt fits over the inner belt and provides a comfortable load bearing platform for the variety of carried items. The integrated front dress belt section or separate dress belt covers the front of the inner belt so that only the outer dress belt is visible when a coat or jacket is worn.

The tactical dress belt assembly of this invention provides a high degree of comfort for the wearer yet still looks professional in a business environment for the individual who needs to support heavy tactical equipment. A suit coat or jacket easily conceals this padded tactical system from a frontal view. Only the dress belt/buckle is visible. The outer utility belt supports the weight of the tactical items and other accessories and comfortably distributes the load over the wearer's hips.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various systems, methods, components and arrangement of systems, methods and components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
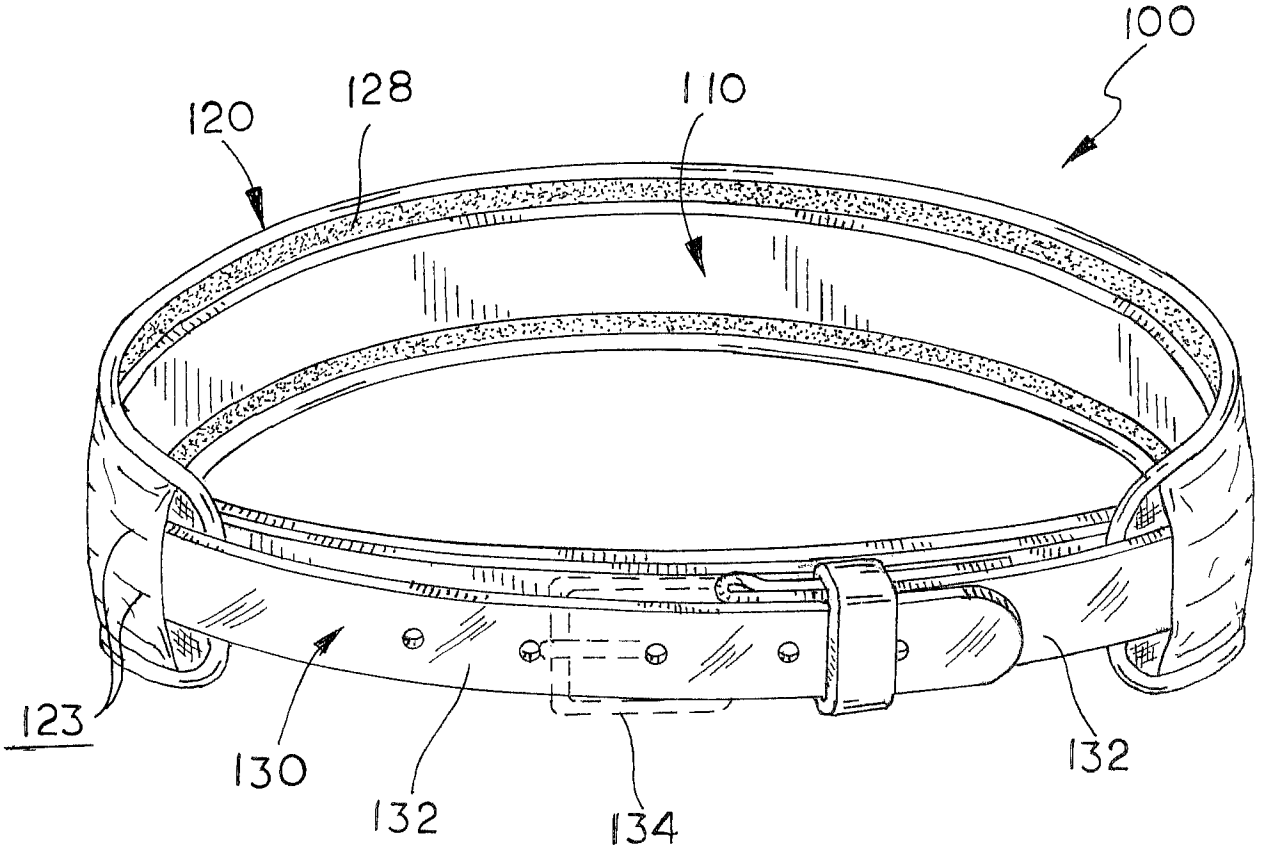
FIG. 1 is a front perspective view of an embodiment of the tactical dress belt assembly of this invention.
Figure 2:
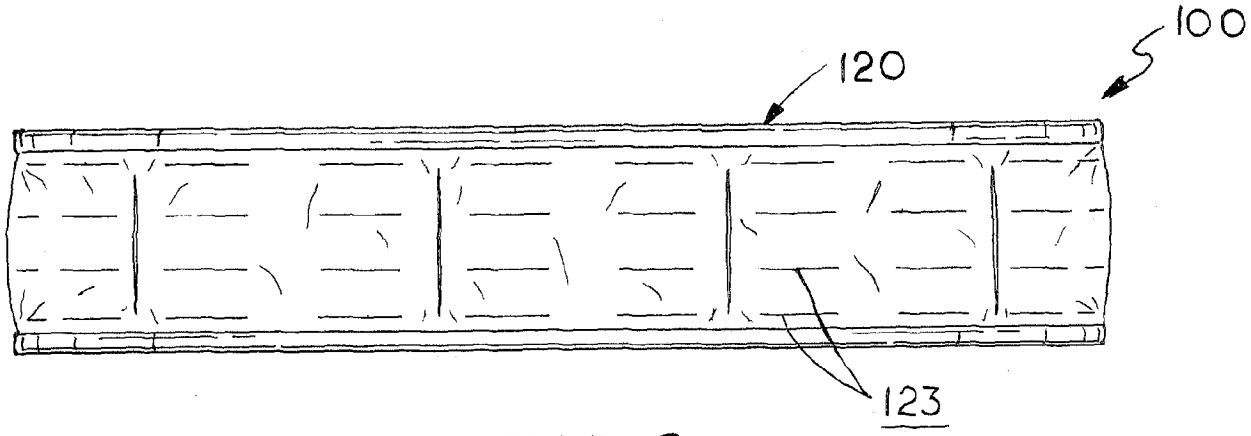
FIG. 2 is a rear view of the tactical dress belt assembly of FIG. 1.
Figure 3:
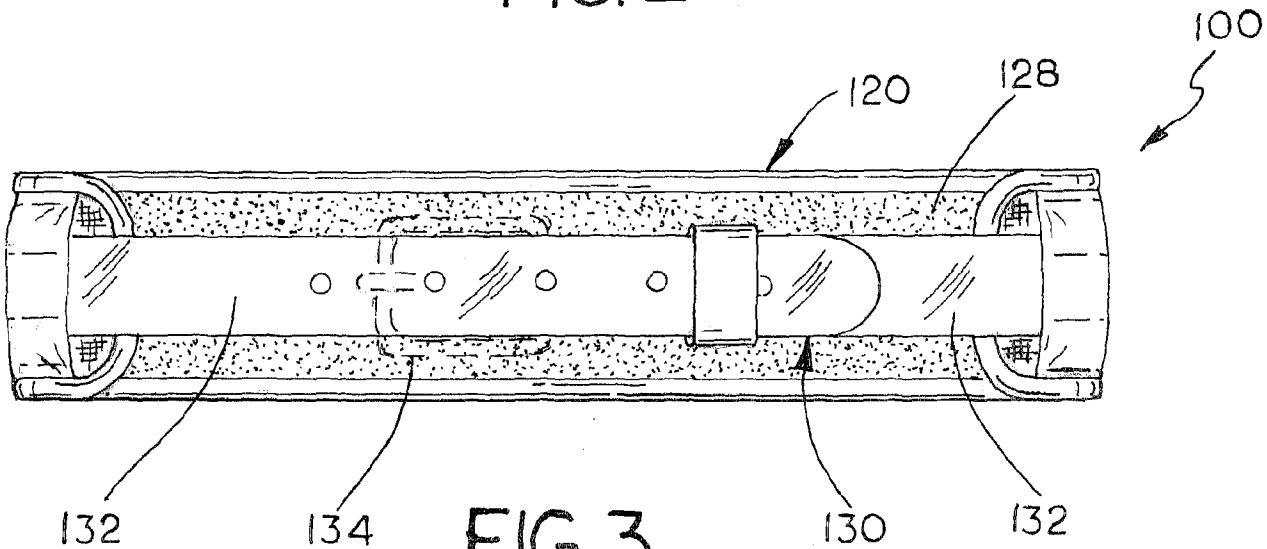
FIG. 3 is a front view of the tactical dress belt assembly of FIG. 1.
Figure 4:
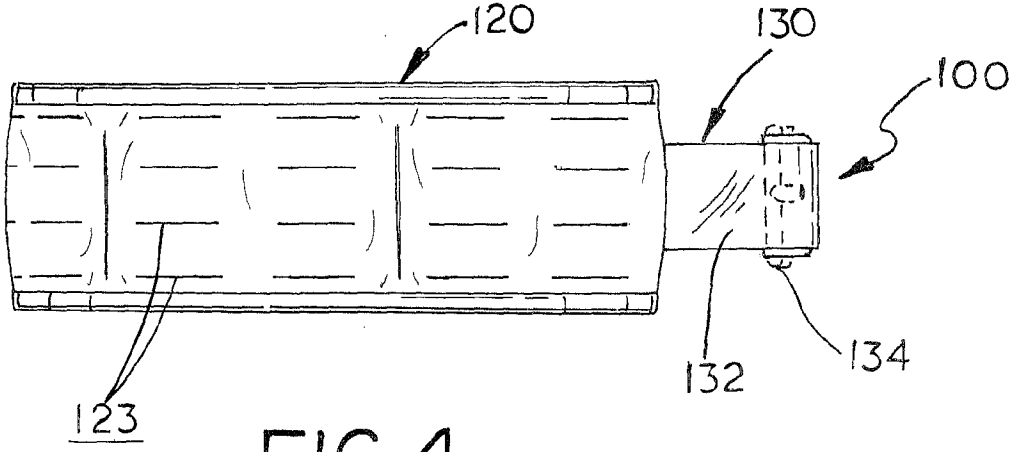
FIG. 4 is a right side view of the tactical dress belt assembly of FIG. 1.
Figure 5:
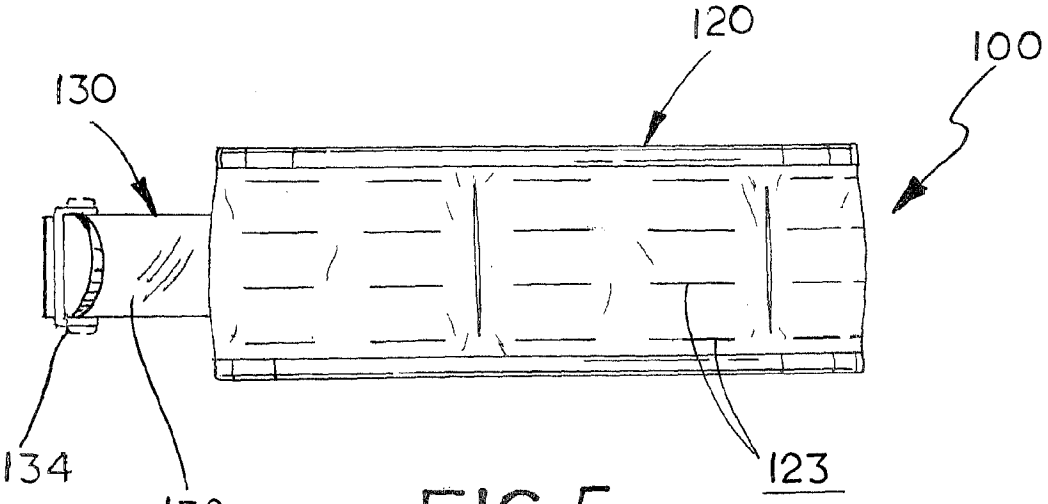
FIG. 5 is a left side view of the tactical dress belt assembly of FIG. 1.
Figure 6:
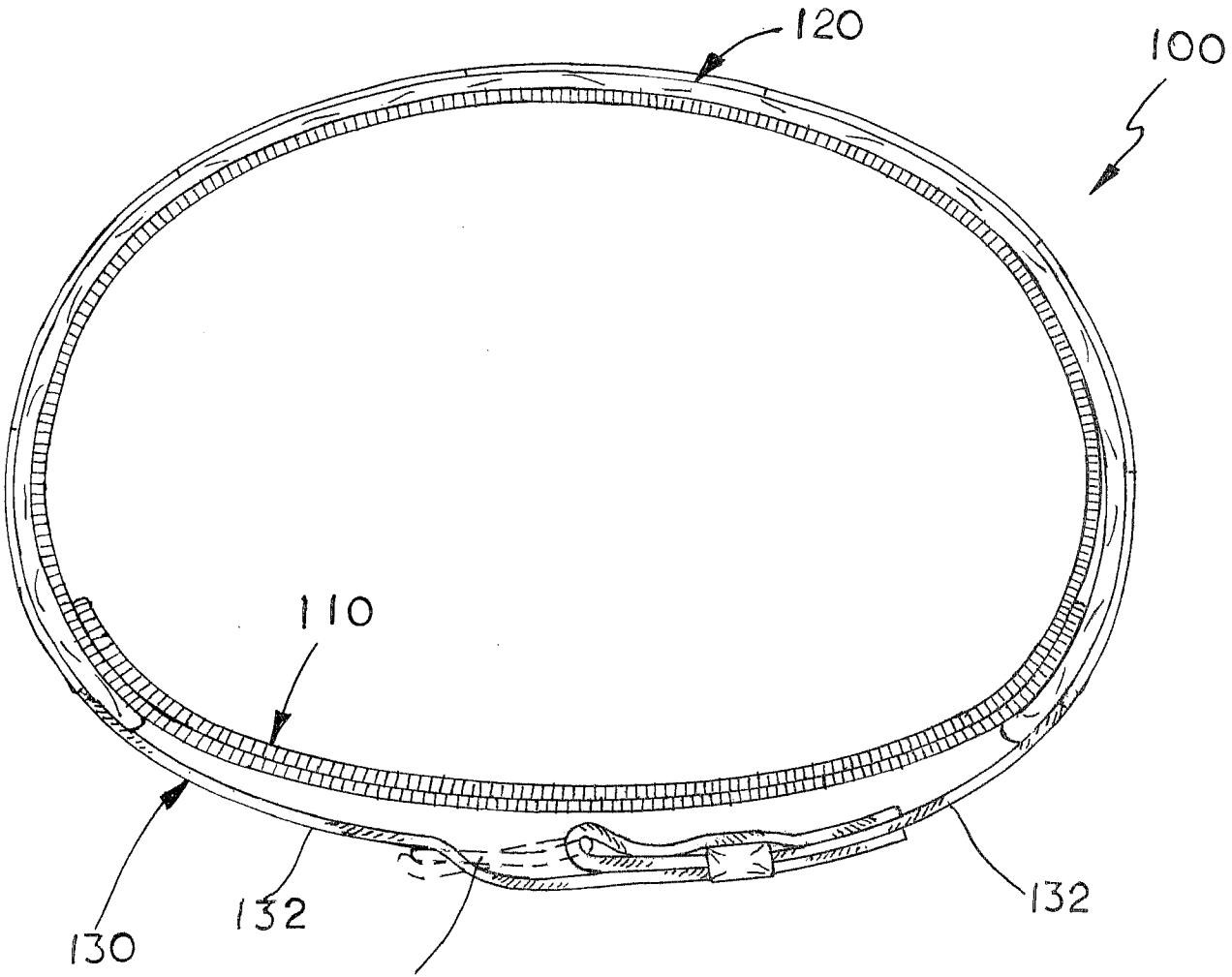
FIG. 6 is a top view of the tactical dress belt assembly of FIG. 1.
Figure 7:
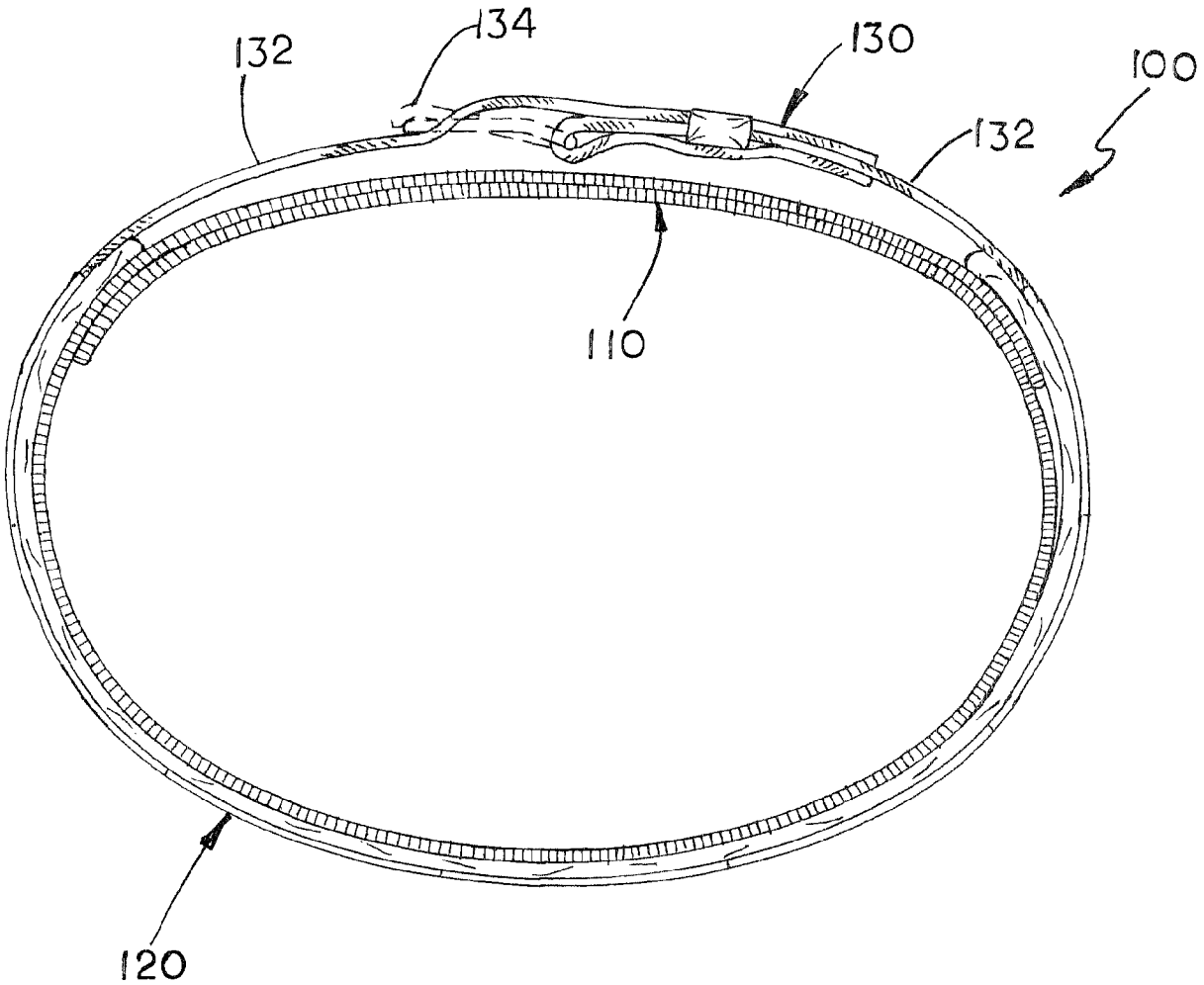
FIG. 7 is a rear view of the tactical dress belt assembly of FIG. 1.
Figure 8:
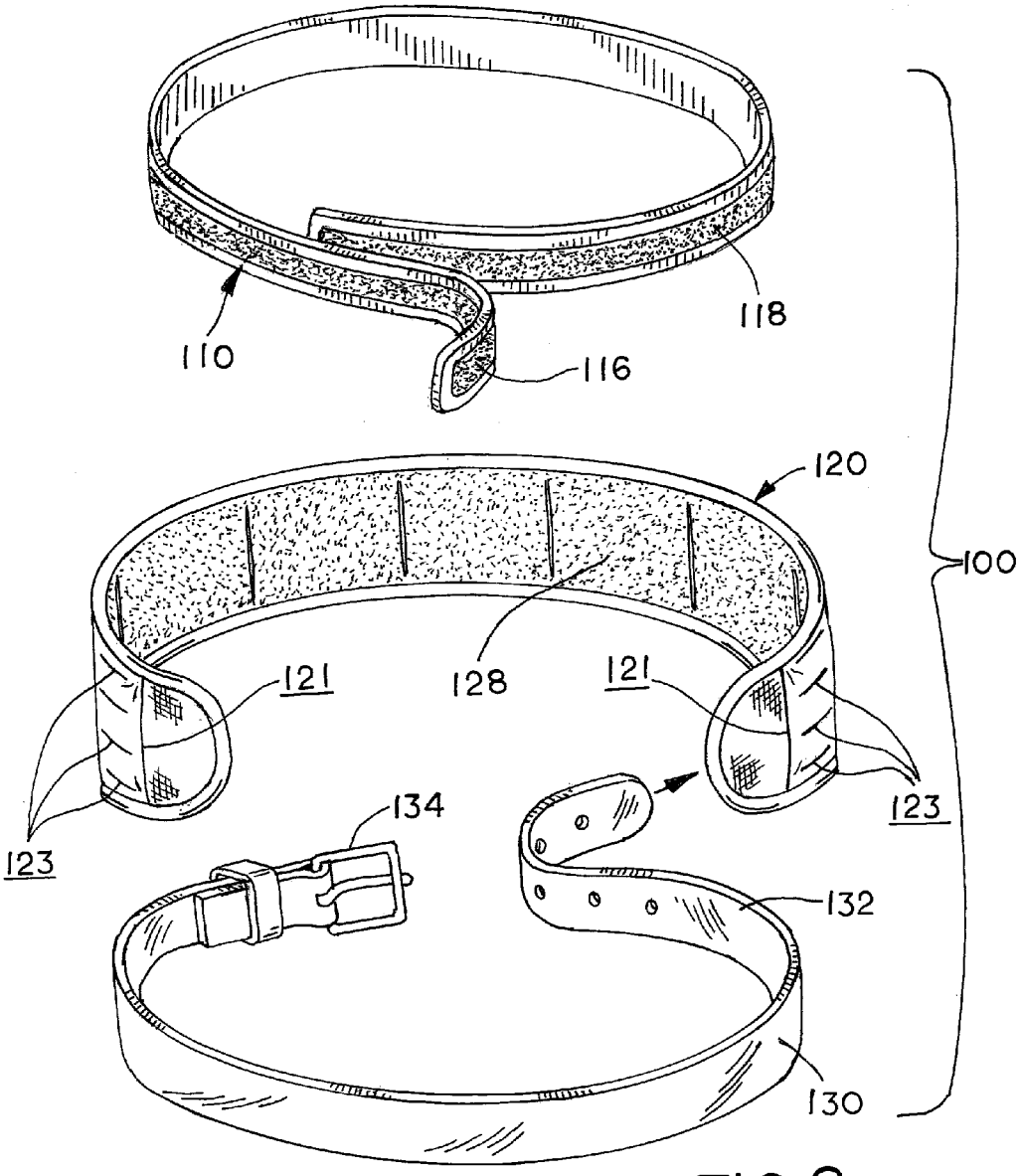
FIG. 8 is an exploded perspective view of the dress belt assembly of FIG. 1.
Figure 9:
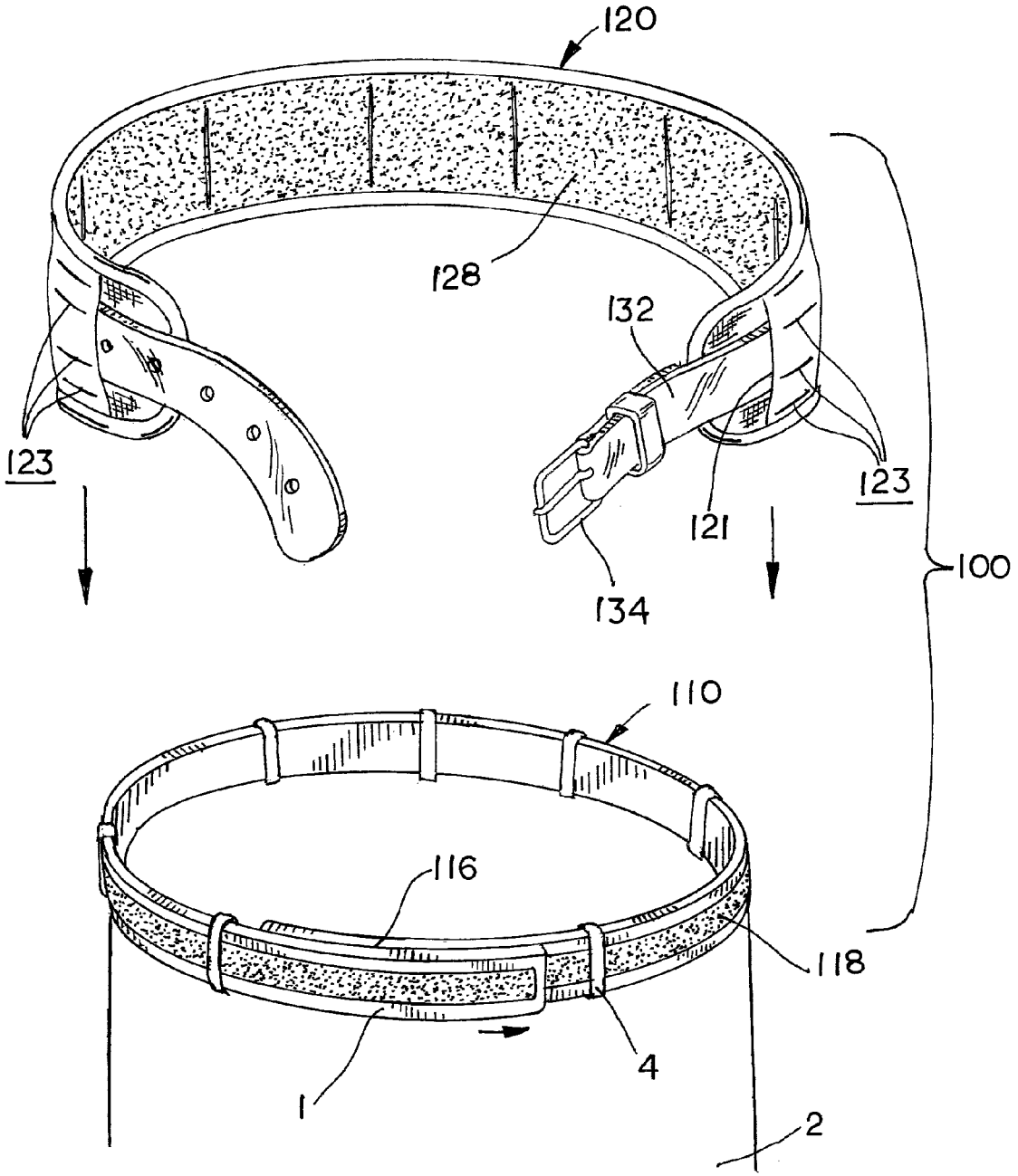
FIG. 9 is another exploded perspective view of the dress belt assembly of FIG. 1 showing the inner belt donned by a wearer.
Figure 10:
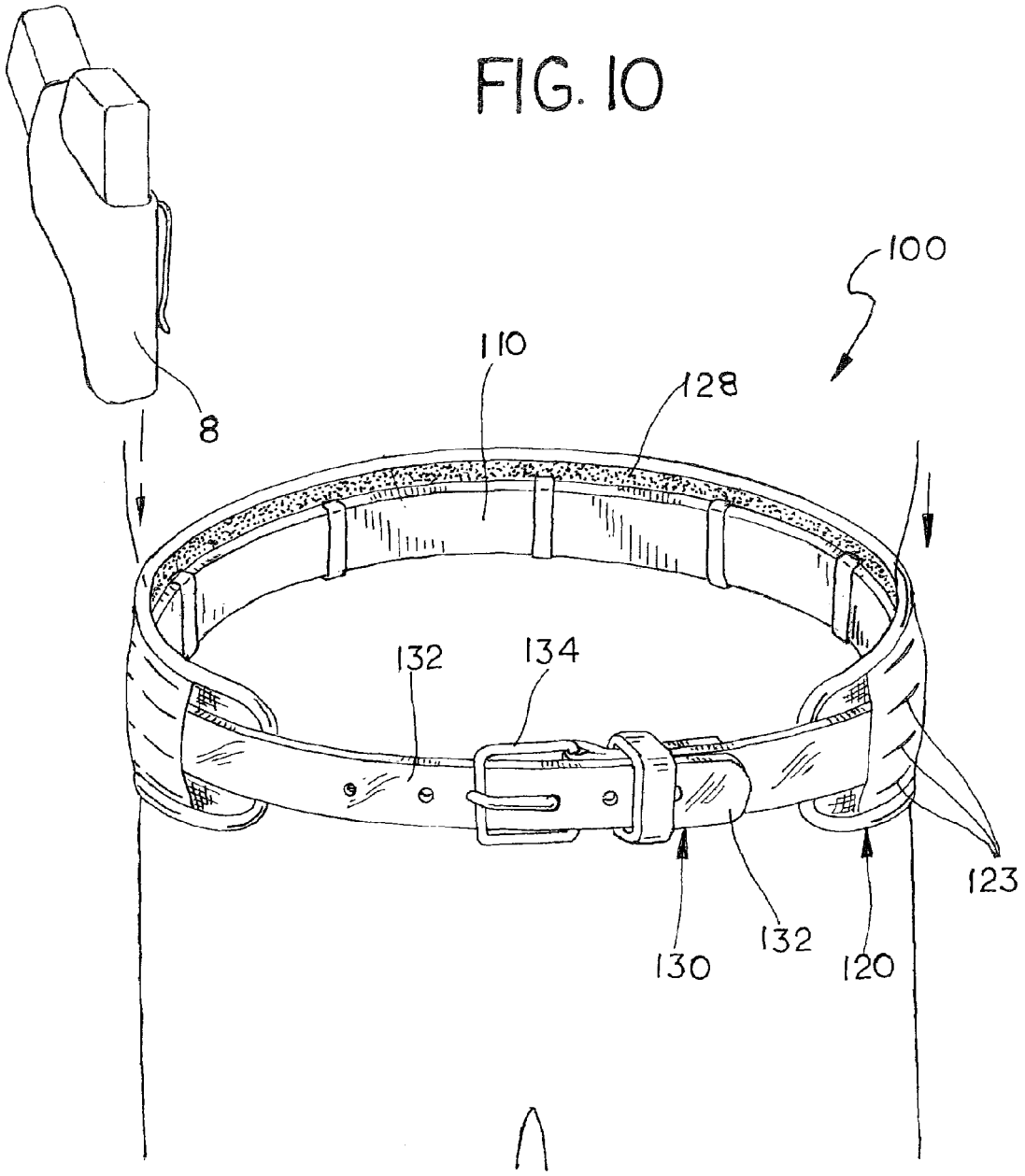
FIG. 10 is a perspective view of the dress belt assembly of FIG. 1 donned by a wearer.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-10 illustrate an embodiment of the tactical dress belt assembly of this invention, which is designated generally as reference numeral 100. As shown, tactical dress belt assembly 100 is a three component system consisting of an inner belt 110, an outer padded belt 120 and an outer dress belt 130.

Typically, inner belt 110 is worn to hold up the wearer's trousers or pants 2 and typically is run through the belt loops 4 of the wearer's trousers. The outer utility belt 120 is worn over inner belt 110 and secured to the inner belt by hook and loop fasteners. Outer dress belt 130 passes through a longitudinal passage in outer utility belt 120 and buckles in the front of the wearer covering the front of inner belt 20 so that only the outer dress belt is visible when a coat or jacket is worn.

Inner belt 110 is constructed from straps of nylon webbing 112. The length and width of the straps are selected as desired for the particular user. Inner belt 110 uses a buckle-less connection whereby the ends of the inner belt are secured by lengths of hook and loop fasteners 116 and 118, such as VELCRO®, sewn to the inside and outside of the webbing.

The length of hook fastener 118 runs the entire length of the outside of inner belt 110, while the length of loop fastener 116 extends only from one end on the inside of inner belt 110.

Outer utility belt 120 provides a load bearing platform for comfortably supporting the various items to be carried covertly by the wearer. Ideally, outer utility belt 120 is constructed of a durable abrasion resistant outer fabric, such as CORDURA®, but other suitable materials may be employed covering closed cell foam padding. The inside of outer utility belt 120 includes a strip of loop fastener 128 that extends around its length. When worn, outer utility belt 120 is securely connected to inner belt 110 by hook fasteners 118 on inner belt 120 and loop fasteners 128 on outer belt 120. A longitudinal passage 121 is formed in outer utility belt 120 underneath the outer fabric panel through which outer dress belt 130 extends. As shown, the outside of outer utility belt 120 is covered in an array of horizontal slots 123, which accommodate the attachment of MOLLE (MOdular Lightweight Load-carrying Equipment) compatible pouches, holster and other accessories. MOLLE accessories and their method of affixation are well known in the art. Slots 123 are typically cut or formed directly into the outer fabric of the outer utility belt 120, which allows the MOLLE compatible accessories, such as holster and magazine pouches to be attached directly to outer utility belt 120 using Malice Clips or similar connectors. Alternatively, other embodiments of the outer utility belts used in this invention may includes an array of PALS (Pouch Attachment Ladder System) webbing (not shown), which also accommodates MOLLE (MOdular Lightweight Load-carrying Equipment) compatible pouches, holsters and other accessories. PALS webbing consists of horizontal rows of heavy-duty 1" nylon webbing. PALS webbing is also well known and understood in the art.

Outer dress belt 130 may take such form or style as to present a civilian decor or discrete appearance obfuscating the tactical functionality of belt assembly 100. Outer dress belt 130 is configured to give a casual or business attire appearance. Outer dress belt 130 includes a strap 132 constructed of any suitable material, such as leather or vinyl and a buckle 134 of any desired make and style. It should be noted that the width of outer dress belt 40 is the same or slightly wider than the width of inner belt 20, such that when worn, the outer dress belt 40 overlaps and covers inner belt 20.

Figure 11:
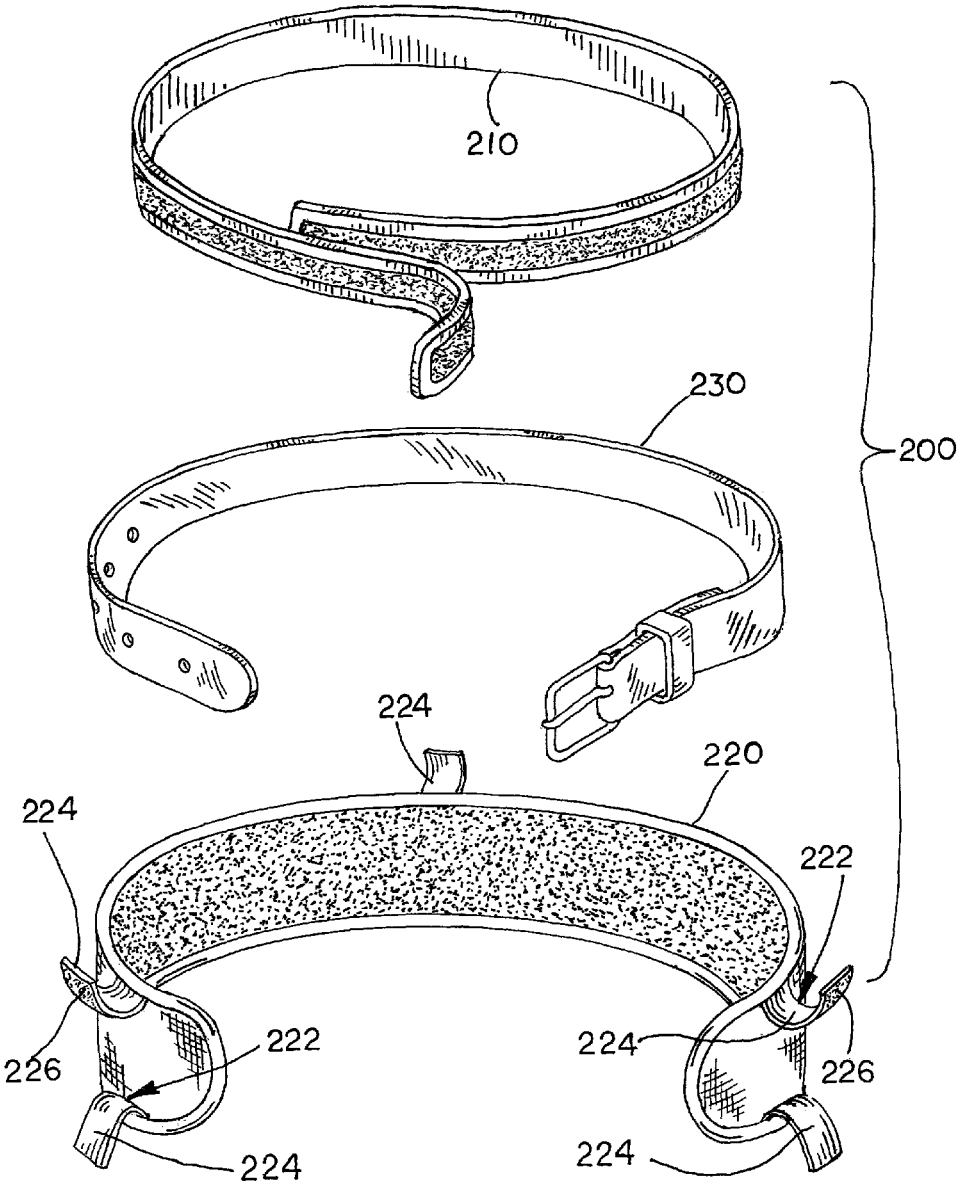
FIG. 11 is an exploded perspective view of a second embodiment of the tactical dress belt assembly of this invention.
Figure 12:
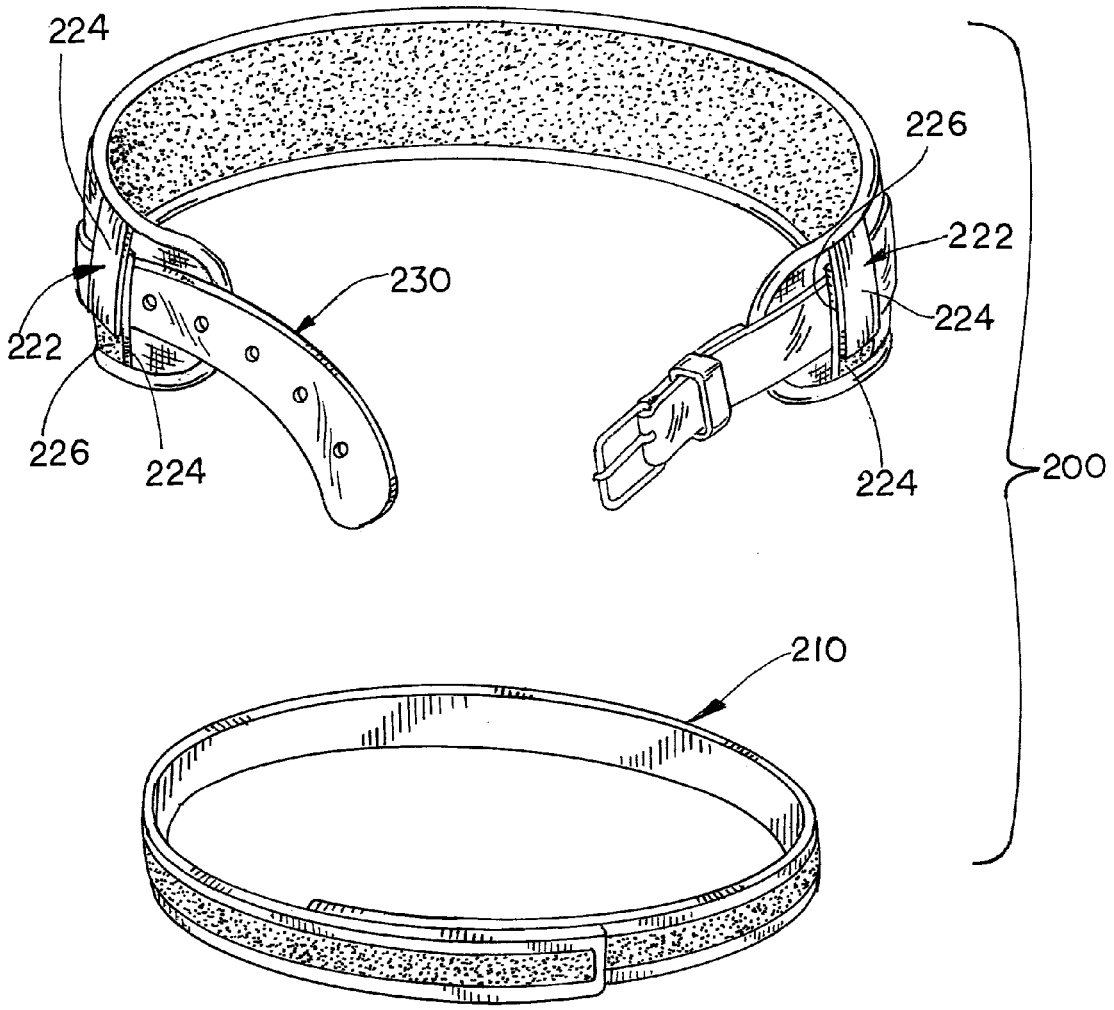
FIG. 12 is another exploded perspective view of the dress belt assembly of FIG. 11.
Figure 13:
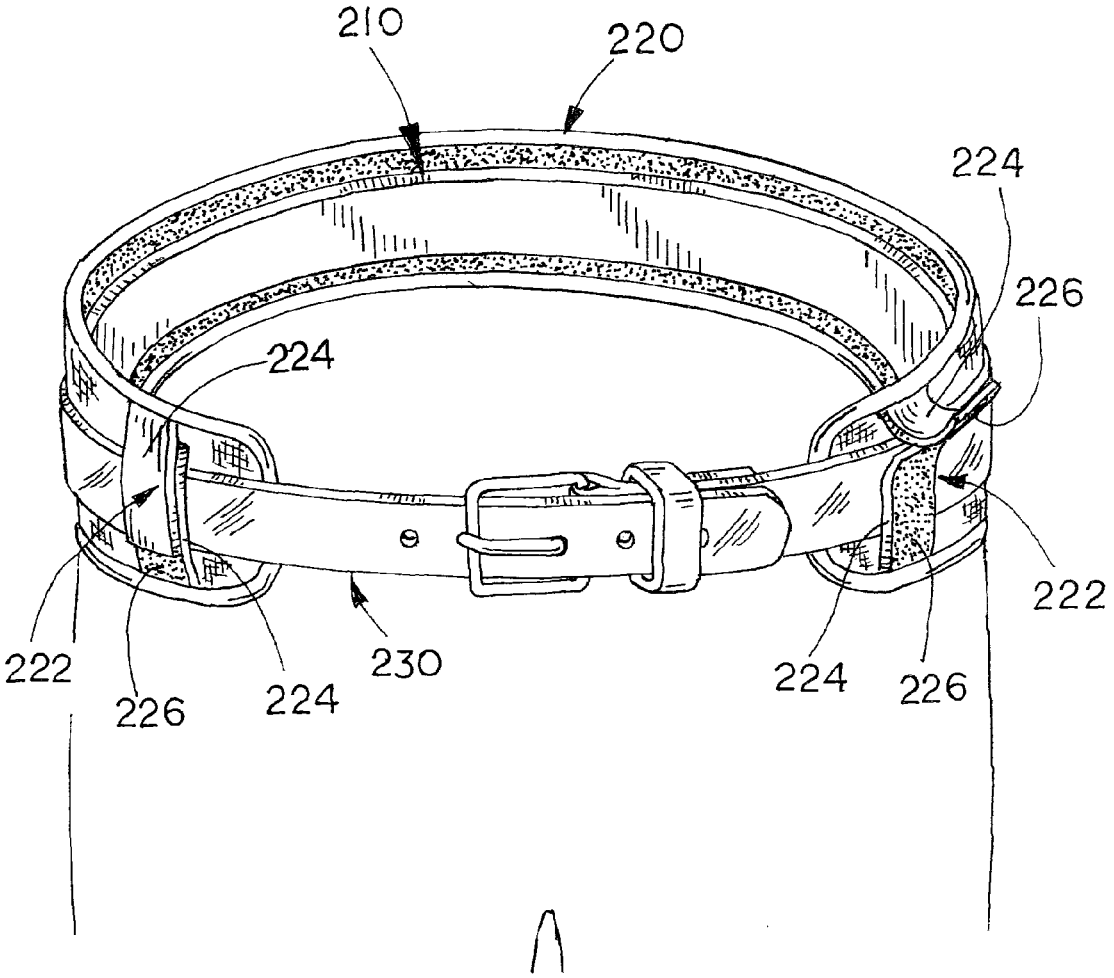
FIG. 13 is a perspective view of the dress belt assembly of FIG. 11.

FIGS. 11-13 illustrate a second embodiment of the tactical dress belt assembly of this invention, which is designated generally as reference numeral 200. Tactical dress belt assembly 200 is similar in construction and function as the previous described embodiment. As with the previous embodiment, assembly 200 is a three component system consisting of an inner belt 210, an outer padded belt 220 and an outer dress belt 230. Again, inner belt 110 is worn to hold up the wearer's trousers or pants (not shown) and outer utility belt 120 is worn over inner belt 110 secured to the inner belt by hook and loop fasteners. Assembly 200 differs from the previous embodiment in that outer dress belt 230 does not extend through an inner passage within outer utility belt 220, but wraps around the outside of the outer utility belt. Outer belt 220 includes a plurality of belt loops 222 for receiving outer dress belt 230 and supporting the dress belt around the outside of outer belt 220. Belt loops 222 consist of two opposed tabs 224 sewn to the outside of outer utility belt 220 that are overlapped and secured by sections of hook and loop fasteners 226.

Figure 14:
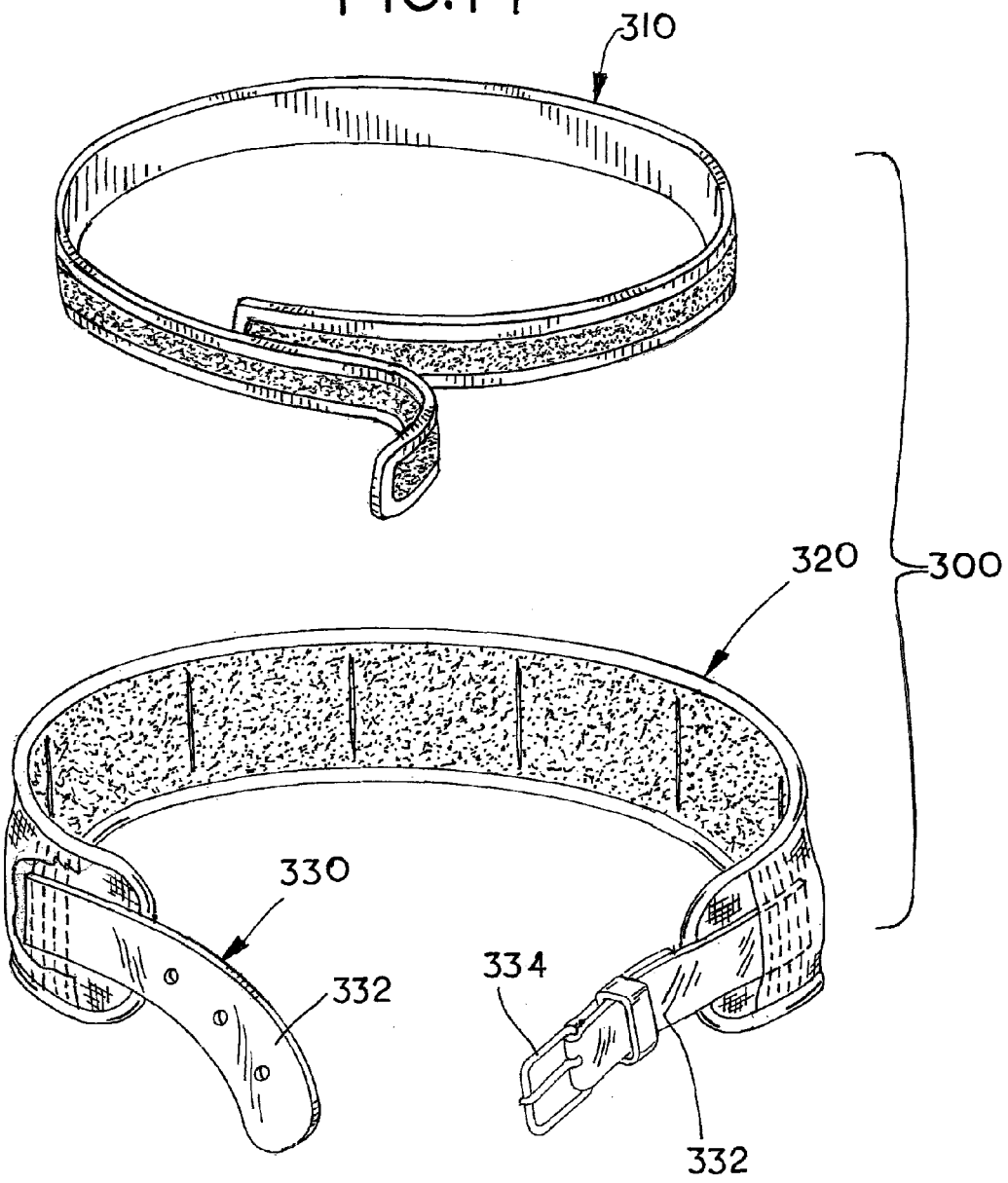
FIG. 14 is an exploded perspective view of a third embodiment of the tactical dress belt assembly of this invention.
Figure 15:
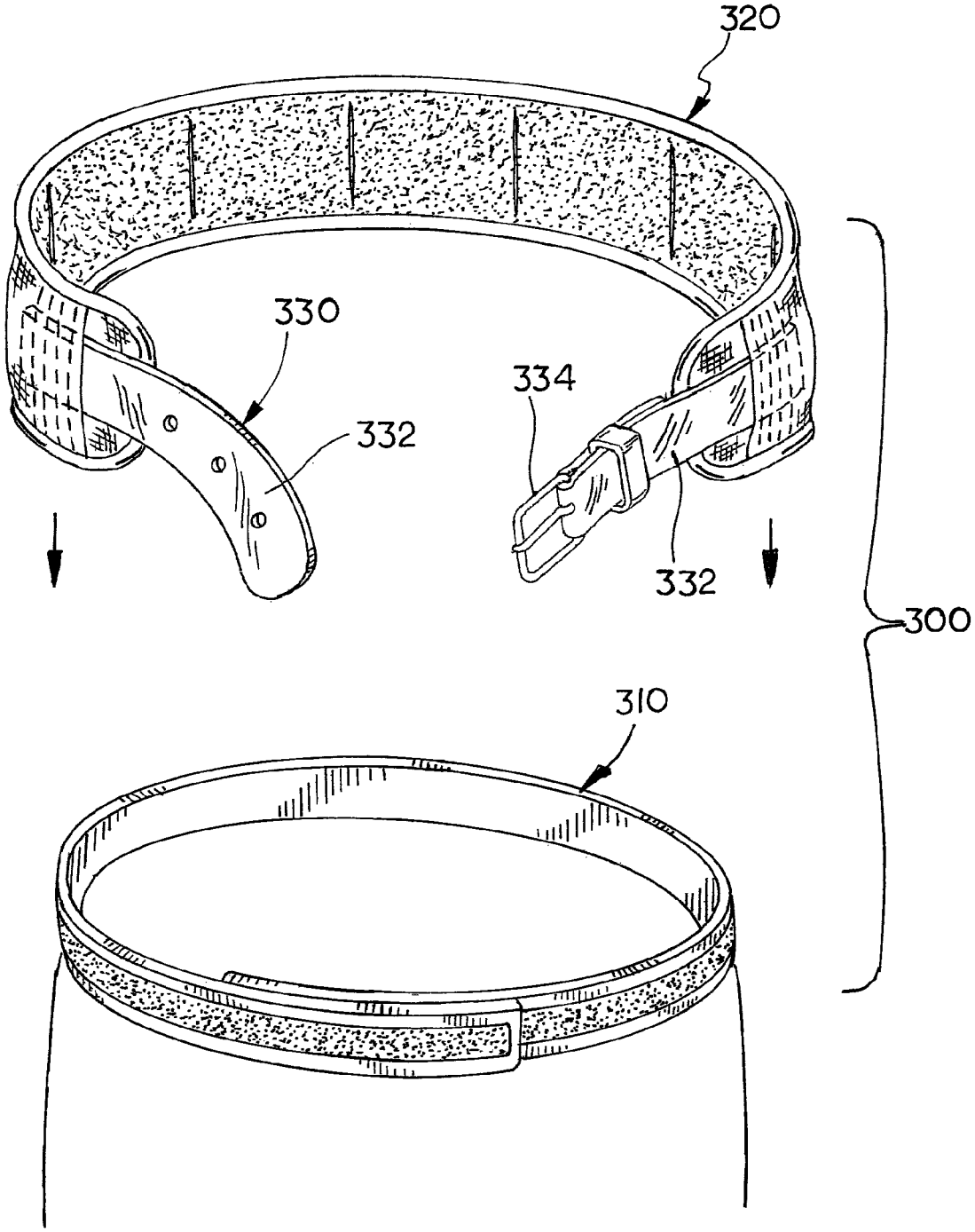
FIG. 15 is another exploded perspective view of the dress belt assembly of FIG. 14.
Figure 16:
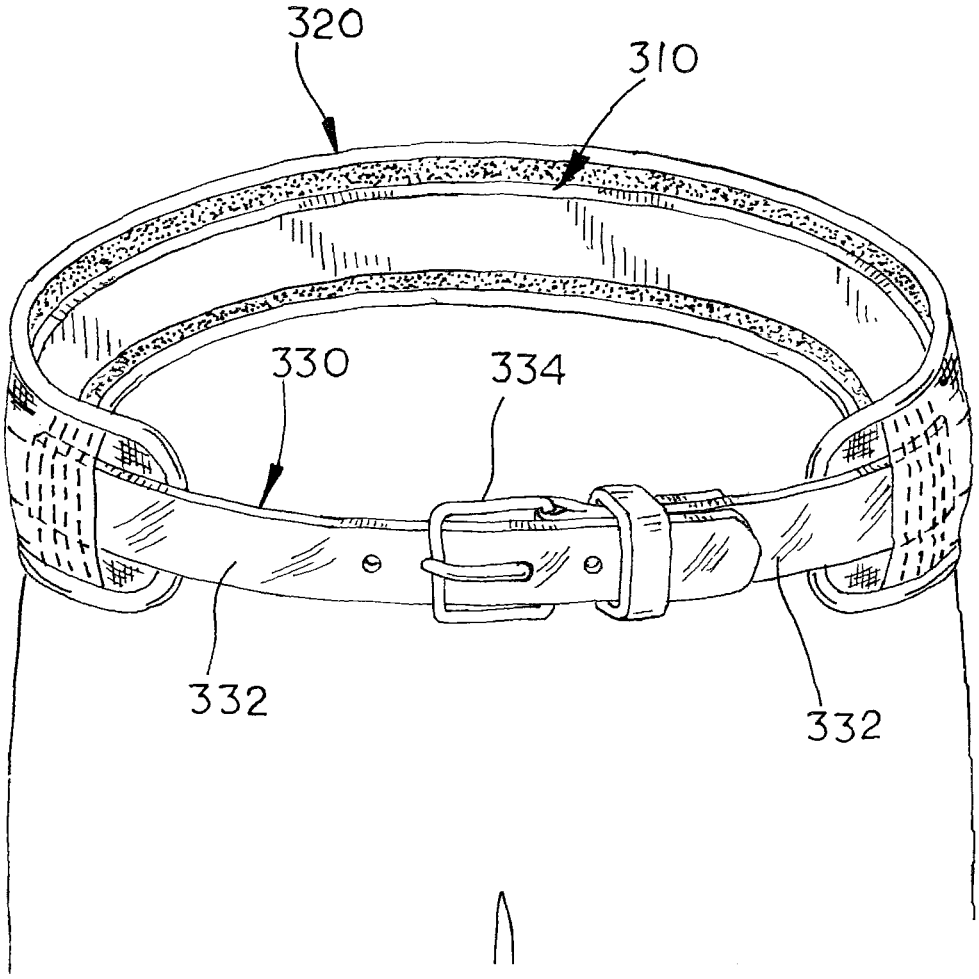
FIG. 16 is a perspective view of the dress belt assembly of FIG. 14.

FIGS. 14-16 illustrate a second embodiment of the tactical dress belt assembly of this invention, which is designated generally as reference numeral 200. Tactical dress belt assembly 300 is similar in construction and function as the previous described embodiment. Belt assembly 300 is similar to that of belt assemblies 100 and 200, except that the front portion of outer dress belt 330 is integrated affixed to outer utility belt 320 in a two component system. Typically, opposed ends of a conventional dress belt are cut or fashioned and then sewn or otherwise affixed directly to the ends of outer belt 320 to form a dress belt front section 330. Belt assembly 300 again includes an inner belt 310 that is run through the belt loops of the wearer's trousers or pants. The outer belt 320 fits over inner belt 110 and is secured by hook and loop fasteners. Outer belt 320 again has the same construction and functionality as with the previous embodiments. Front section 330 consists of two straps 332 sewn to the ends of outer utility belt 320 and a conventional belt buckle 324. Again, straps 332 may be of any desired material, such as leather or vinyl, and buckle 334 may take any desired shape, style or configuration. Also the width of straps 332 are again selected to overlap and cover inner belt 210. Outer belt 320 provides the load bearing platform for the assembly and the integrated opposed ends of dress belt 330 provide the casual, covert appearance to the assembly when the dress belt front section 330 covers inner belt 310.

One skilled in the art will note that the tactical dress belt assembly of this invention provides a high degree of comfort for the wearer yet still looks professional in a business environment for the individual who needs to support heavy tactical equipment. A suit coat or jacket easily conceals this padded tactical system from frontal view. Only the dress belt/buckle is visible. Both embodiments of the assembly provide a high degree of comfort for the wearer yet still look professional in a business environment for the individual who needs to support heavy tactical equipment. The outer utility belt supports the weight of the tactical items and other accessories and comfortably distributes the load over the wearer's hips. In certain embodiments, the outer utility belt is MOLLE compatible enabling the use of MOLLE compatible accessories, such as holsters and magazine pouches.

It should be apparent from the foregoing that an invention having significant advantages has been provided. While the invention is shown in only a few of its forms, it is not just limited but is susceptible to various changes and modifications without departing from the spirit thereof. The embodiments of the present invention herein described and illustrated are presented to explain the invention so that others skilled in the art might utilize its teachings. The embodiment of the present invention may be modified within the scope of the following claims.

We claim:

1. A belt assembly for supporting articles carried by a wearer donning trousers having a plurality of belt loops, the belt assembly comprising:

a first belt member adapted to extend through the plurality of belt loops of the trousers and affix around a wearer;

a second belt member wider than the first belt member and adapted to support articles carried by the wearer, the second member detachably connected to the first belt member to only cover and overlie a portion of the first belt member around the back and sides of the wearer, the second belt member having a pair of opposed ends thereof, the opposed ends of the second belt member are spaced from each other when the belt assembly is donned by the wearer; and a third belt member narrower than the second belt member and at least as wide as the first belt member, the third belt member carried by the second belt member and extending from the opposed ends of the second belt member to longitudinally overlay and visibly cover and obstruct from view the first belt member when the second belt member is mounted to the first belt member.

2. The belt assembly of claim 1 wherein the first belt member has opposed ends interconnected by hook and loop fasteners affixed thereto.

3. The belt assembly of claim 1 wherein the first belt member and the second belt member are interconnectable by hook and loop fasteners affixed to the first belt member and the second belt member.

4. The belt assembly of claim 3 wherein the second belt member has an inner face thereof, the first belt member having an outer face, one of the hook and loop fasteners affixed to the inner face of the second belt member and the other of the hook and loop fasteners affixed to the outer face of the first belt member.

5. The belt assembly of claim 1 wherein the outer face of the second belt member has a plurality of slots formed therein.

6. The belt assembly of claim 1 wherein the second belt member has longitudinal passage defined therein for receiving the third belt member therein.

7. The belt assembly of claim 1 wherein the second belt member includes a plurality of belt loops affixed to the outer face of the second belt member for supporting the third belt member.

8. The belt assembly of claim 1 wherein the third belt member includes a first strap extending longitudinally from one of the opposed ends of the second belt member and a second strap extending longitudinally from the other of the opposed ends of the second belt member, one of the first strap and the second strap having a buckle.

9. The belt assembly of claim 8 wherein the first strap and the second strap are constructed of leather.

* * * * *